US009687977B2

(12) United States Patent
Papp

(10) Patent No.: US 9,687,977 B2
(45) Date of Patent: Jun. 27, 2017

(54) ELECTRIC POWER TOOL, IN PARTICULAR DRILL/SCREWDRIVER

(75) Inventor: Gabor Papp, Miskolc (HU)

(73) Assignee: Robert Bosch GmbH, Stuttgart (DE)

( * ) Notice: Subject to any disclaimer, the term of this patent is extended or adjusted under 35 U.S.C. 154(b) by 858 days.

(21) Appl. No.: 13/696,341

(22) PCT Filed: Apr. 15, 2011

(86) PCT No.: PCT/EP2011/056029

§ 371 (c)(1),
(2), (4) Date: Mar. 20, 2013

(87) PCT Pub. No.: WO2011/147641

PCT Pub. Date: Dec. 1, 2011

(65) Prior Publication Data

US 2013/0206435 A1 Aug. 15, 2013

(30) Foreign Application Priority Data

May 25, 2010 (DE) ..... 10 2010 029 267

(51) Int. Cl.
*B25F 5/00* (2006.01)
*B25B 21/00* (2006.01)

(52) U.S. Cl.
CPC ..... *B25F 5/001* (2013.01); *B25B 21/00* (2013.01)

(58) Field of Classification Search
CPC ..... B25B 23/14; B25B 23/147; B25B 21/008; B25B 21/02–21/026; B25F 5/001
USPC ..... 388/937; 318/432, 434; 200/547–550, 200/522; 173/11, 18, 47
See application file for complete search history.

(56) References Cited

U.S. PATENT DOCUMENTS 3,646,375 A * 2/1972 Mader ..... H01C 10/14 310/78
4,536,688 A * 8/1985 Roger ..... B23B 45/001 318/490
4,823,885 A * 4/1989 Okumura ..... B23B 45/008 173/178

(Continued)

FOREIGN PATENT DOCUMENTS

CN 1095327 A 11/1994
CN 2545688 Y 4/2003

(Continued)

OTHER PUBLICATIONS

International Search Report corresponding to PCT Application No. PCT/EP2011/056029, mailed Jul. 22, 2011 (German and English language document) (5 pages).

*Primary Examiner* — Stephen F Gerrity
*Assistant Examiner* — Joshua Kotis
(74) *Attorney, Agent, or Firm* — Maginot, Moore & Beck LLP

(57) ABSTRACT

An electric power tool, in particular a drill/screwdriver, has a drive motor which is coupled via a gearbox to an output drive element. The gearbox has a plurality of gears. In particular, the drive motor is coupled to a drive spindle in which the torque generated by the drive motor is adjustable. The torque can be adjusted by a first, manually operated, adjusting device, and by a second, manually operated, adjusting device. The second adjusting device is configured to adjust the torque by selecting the gear of the gearbox. Both adjusting devices are operated by a common actuating element.

11 Claims, 6 Drawing Sheets

(56) References Cited

U.S. PATENT DOCUMENTS 5,014,793 A * 5/1991 Germanton ..... B25B 21/00 173/181
5,451,127 A * 9/1995 Chung ..... B25D 16/006 173/47
5,889,922 A * 3/1999 Bufe ..... B25B 21/02 318/245
6,104,105 A * 8/2000 Schaeffeler ..... H01H 9/061 200/522
6,502,648 B2 * 1/2003 Milbourne ..... B25B 21/00 173/146
6,927,353 B2 * 8/2005 Bader ..... H01H 9/061 200/522
6,983,807 B2 * 1/2006 Mayr ..... B25D 16/00 173/48
6,983,809 B2 * 1/2006 Leitenberger ..... B25B 21/00 173/176
2002/0011840 A1 * 1/2002 Li ..... G01D 5/147 324/207.21
2003/0089511 A1 * 5/2003 Tsuneda ..... B25B 21/00 173/217
2004/0112616 A1 * 6/2004 Broghammer ..... B25F 5/02 173/217
2005/0224242 A1 * 10/2005 Britz ..... B25D 16/006 173/15
2005/0263305 A1 * 12/2005 Shimizu ..... B25B 23/1405 173/2
2006/0113097 A1 * 6/2006 Simm ..... B25D 16/006 173/48
2007/0144310 A1 * 6/2007 Pozgay ..... B25B 21/00 81/57.26
2008/0122404 A1 * 5/2008 Brotto ..... B25F 5/00 320/114
2009/0016834 A1 * 1/2009 Scrimshaw ..... B23B 31/123 408/139
2009/0071671 A1 * 3/2009 Zhong ..... B23B 45/008 173/176
2009/0098971 A1 * 4/2009 Ho ..... B23B 45/008 475/153
2009/0101376 A1 * 4/2009 Walker ..... B25B 21/00 173/47
2009/0126957 A1 * 5/2009 Schroeder ..... B25D 16/006 173/48
2009/0188691 A1 * 7/2009 Hahn ..... B25D 17/043 173/162.2
2009/0200053 A1 * 8/2009 Scrimshaw ..... B23B 31/123 173/47
2009/0277658 A1 * 11/2009 Chen ..... B23B 45/008 173/183
2010/0071923 A1 * 3/2010 Rudolph ..... B25B 21/00 173/48
2010/0212923 A1 * 8/2010 Zimmermann ..... B23B 45/008 173/47
2011/0000691 A1 * 1/2011 Roehm ..... B25F 5/001 173/47
2012/0305276 A1 * 12/2012 Liptak ..... B25F 5/00 173/47

FOREIGN PATENT DOCUMENTS

| | | | |
|---|---|---|---|
| CN | 1424169 | A | 6/2003 |
| CN | 1579712 | A | 2/2005 |
| CN | 101300110 | A | 11/2008 |
| CN | 101621273 | A | 1/2010 |
| DE | 10 2004 051 911 | A1 | 4/2006 |
| EP | 1 857 228 | A1 | 11/2007 |
| GB | 2 327 054 | A | 1/1999 |
| GB | 2 404 891 | A | 2/2005 |
| WO | 2007/056254 | A2 | 5/2007 |

* cited by examiner

ELECTRIC POWER TOOL, IN PARTICULAR DRILL/SCREWDRIVER

This application is a 35 U.S.C. §371 National Stage Application of PCT/EP2011/056029, filed on Apr. 15, 2011, which claims the benefit of priority to Serial No. DE 10 2010 029 267.2, filed on May 25, 2010 in Germany, the disclosures of which are incorporated herein by reference in their entirety.

BACKGROUND

The disclosure relates to an electric power tool, in particular a drill/screwdriver, as described below.

Such an electric power tool is known from DE 10 2004 051 911 A1 of the applicant. The known electric power tool in that case has two positioning rings, realized as separate actuating elements, the first positioning ring being used for the operating mode "drilling" and "screwdriving" with the possibility of setting a maximum torque to be transmitted, and the other positioning ring being used to set a percussion drilling function. For the purpose of setting and changing operating parameters in differing types of operation, therefore, the operator has to operate two actuating elements, or positioning rings, that are separate from each other, only one of the actuating elements being active in each case. Operation therefore requires knowledge of the functionality of the two actuating elements. Furthermore, the known electric power tool has a relatively elaborate structure, owing to the two positioning rings, and the arrangement of the two actuating elements requires a relatively large amount of structural space.

SUMMARY

Starting from the prior art described, the disclosure is based on the object of developing an electric power tool, in particular a drill/screwdriver, as described below, in such a way that its structure is simplified through a reduction of adjusting elements and, at the same time, operation is made relatively easy for the operator. This object is achieved in the case of an electric power tool, in particular a drill/screwdriver, having the features described below. The disclosure in this case is based on the idea of actuating both adjusting devices for the respective operating modes via a common actuating element. In other words, this means that two adjusting devices can be actuated in differing operating modes by means of a single actuating element. Consequently, compared with the prior art, a simplified structure is achieved because of a reduction in the number of components. At the same time, the operation of the two adjusting devices is simplified. In addition, the disclosure has the advantage that, owing to the saving in operating elements, a particularly compact structure of the electric power tool can be achieved, since only structural space for a single actuating element is required.

Advantageous developments of the electric power tool according to the disclosure are specified below. All combinations of at least two features disclosed, the description and/or the figures are included within the scope of the disclosure.

In a configuration implementation of the disclosure that provides a high degree of robustness of the electric power tool, in particular of the actuating element, it is proposed that the actuating element is realized as a mechanical actuating element in the form of a sliding or rotary switch.

In order, on the one hand, to provide for unambiguous assignment to the individual adjusting devices in the actuation of the actuating element, the assignment being, moreover, easily understood by an operator, it is additionally proposed that the actuating element has a first adjustment range, in which the actuating element acts exclusively in combination with the first adjusting device, and has a second adjusting range, which adjoins the first adjusting range and in which the actuating element acts exclusively in combination with the second adjusting device.

To enable the position of the actuating element for the first adjusting device to be identified in a simple and stepless manner, it is proposed, in a preferred embodiment of the disclosure, that the first adjusting device, for the purpose of torque setting, comprises a potentiometer for identifying the position of the actuating element, the resistance value of which potentiometer can be varied by means of a contact element that is arranged on the actuating element and that acts as a jumper between printed conductors.

Also preferred is an embodiment in which the position of the actuating element is represented by means of an optical indicator. Such an optical indicator can be seen relatively easily by an operator, and thus enables the desired switching position of the actuating element to be set particularly accurately.

It is particularly preferred in this case if the optical indicator is arranged in the region of the adjustment path of a control element of the actuating element.

BRIEF DESCRIPTION OF THE DRAWINGS

Further advantages, features and details of the disclosure are given by the following description of preferred exemplary embodiments and with reference to the drawings.

In the drawings.

DETAILED DESCRIPTION

Figure 1:
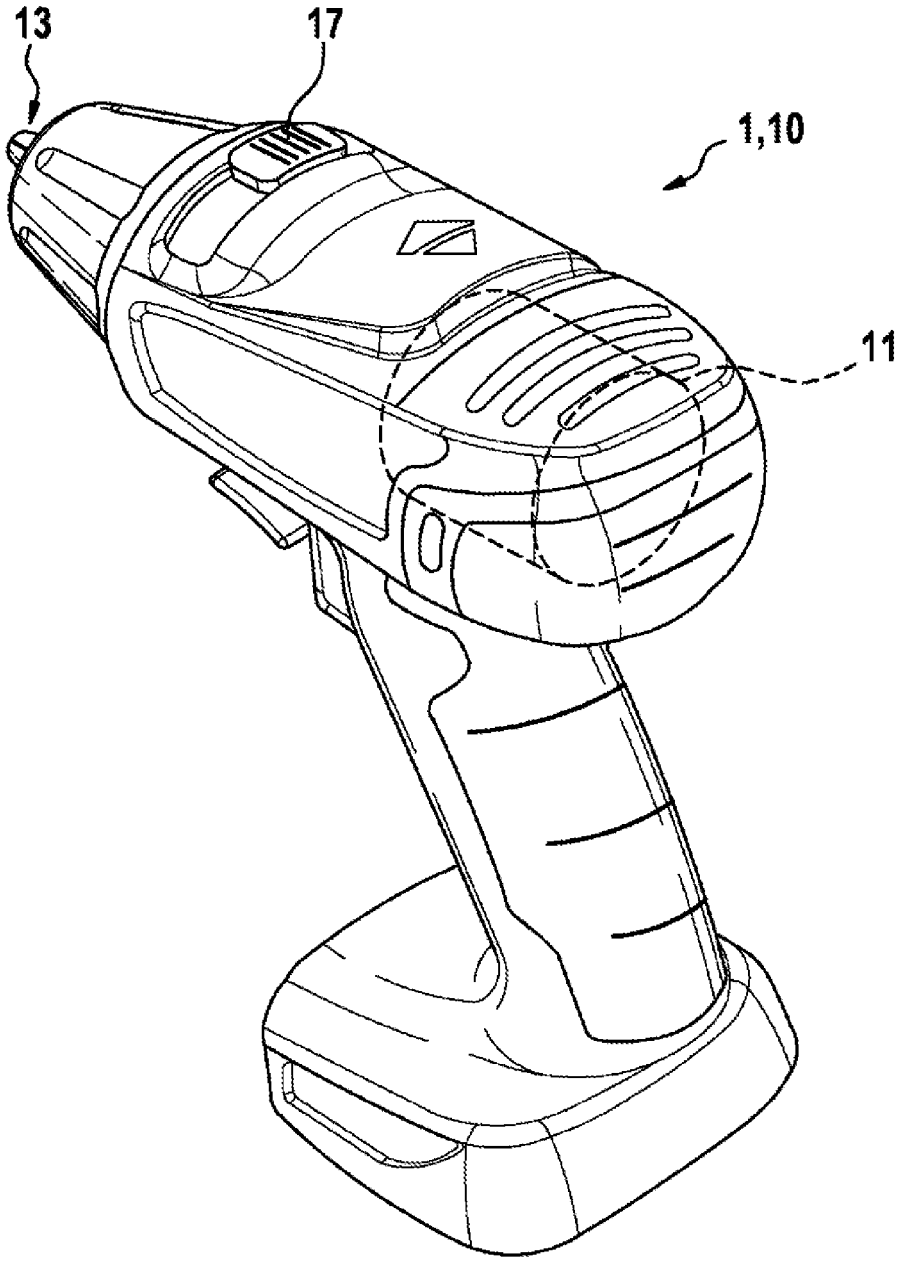
FIG. 1 shows a perspective view of an electric power tool according to the disclosure, in the form of a drill/screwdriver.

In the figures, components that are the same, or that have the same function, are denoted by identical reference numerals in each case.

FIG. 1 shows an electric power tool 10 according to the disclosure, in the form of a battery-operated drill/screwdriver 1. In a manner known per se, the electric power tool 10 has a drive motor 11, which acts upon a drive spindle 13 via a transmission 12. Further, the transmission 12 of the electric power tool 10 has at least two gear stages (not represented), of which the first gear stage, which has a higher reduction ratio than the second gear stage, is used for screwdriving, while the second gear stage is suitable for drilling. What is then essential is that the maximum torque of the drive motor 11 that is to be transmitted to the drive spindle 13 can be set for the screwdriving function.

According to the disclosure, it is provided that both the setting of the maximum torque to be transmitted during screwdriving operation mode and the gear change necessary for shifting from screwdriving operation into drilling operation are effected by means of a single actuating element 15. In this case, in the exemplary embodiment represented, the actuating element 15 is realized as a sliding switch realized as a rotary ring 16. In addition, it is to be mentioned that the actuating element 15 could also be realized as a rotary switch, instead of as a rotary ring 16.

The rotary ring 16 adjustable within a defined rotary angle range, in the housing of the drill/screwdriver 1. A control element 17 is used for this purpose, which can be actuated by an operator from the outside, and which is preferably steplessly adjustable within the adjustment range, or rotary angle range, of the rotary ring 16. The respective position of the control element 17, or of the rotary ring 16, is indicated by means of an optical indicator 18. The optical indicator 18 in this case comprises two indicator fields 19, 20, arranged separately from each other, in which there are arranged, in particular, a multiplicity of LEDs. What is essential in this case is that, in the one indicator field 19, there is the actuating element 15 in the activated first operating mode, in which the drill/screwdriver 1 enables screwdriving operation, while the second indicator field 20 serves to indicate drilling operation. The arrangement of the indicator fields 19, 20 is such that the respectively illuminated LEDs correlate to, or are aligned with, the position of the operating element 17.

Figure 3:
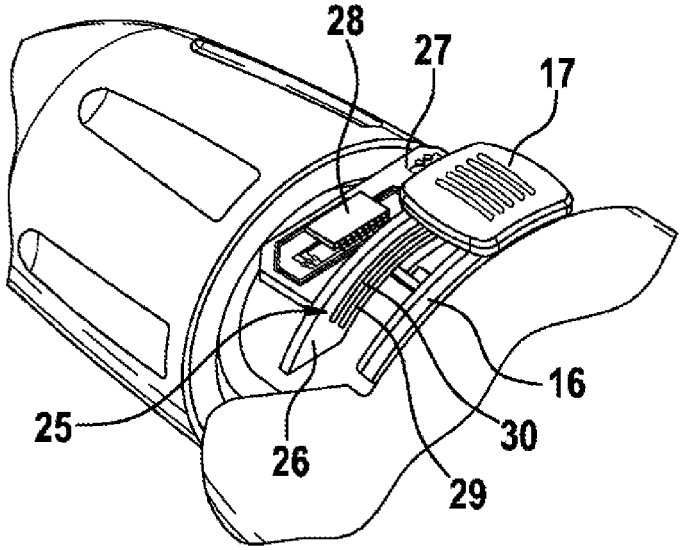
FIG. 3 and FIG. 4 show a perspective, partially sectional view of the electric power tool in the region of the first adjusting device, from differing perspectives.
Figure 4:
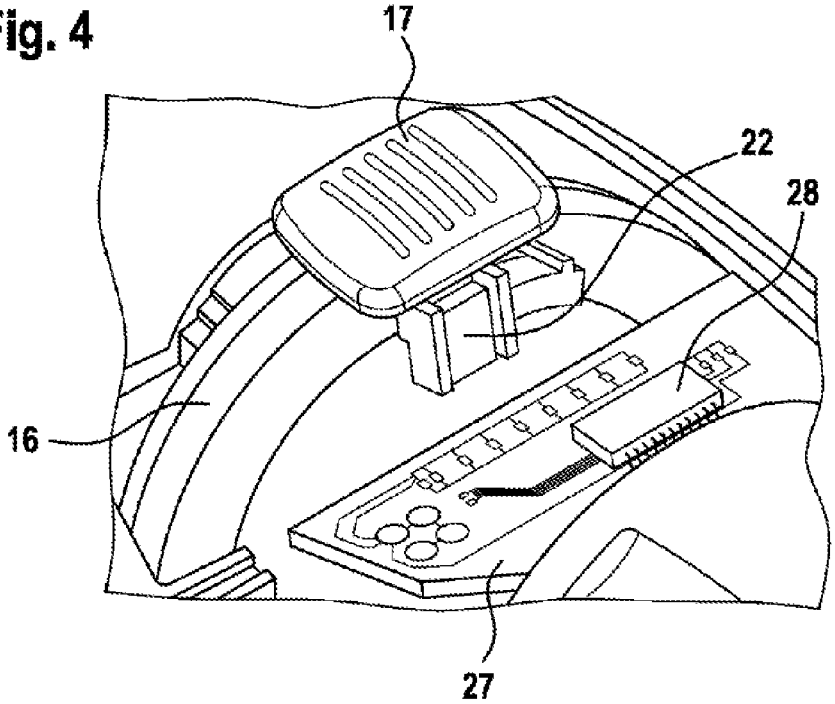

As can be seen, in particular, from FIGS. 3 and 4, the rotary ring 16 has, on one outside face, an electrically acting contact element 22, which is received in a positive manner in a preferably molded on recess on the rotary ring 16. The contact element 22 is a constituent part of a potentiometer 25, which is realized on an arcuate circuit board 26. The circuit board 26, in turn, is connected to a circuit carrier 27, on which there are arranged evaluating means 28 suitable for acquiring the position of the contact element 22 relative to the circuit board 26. For this purpose, the circuit board 26 has two printed conductors 29, 30, which are arranged at a distance apart from each other and which are electrically jumpered by means of the contact element 22. The position of the contact element 22, and therefore the rotary angle position of rotary ring 16, is acquired in that, according to the position of the rotary ring 16, the contact element 22 likewise assumes an unambiguous position that corresponds to the position of the rotary ring 16. The contact element 22 in this case jumpers the two printed conductors 29, 30 on the circuit board 26, such that the potentiometer 25 generates a quite particular resistance value, which is acquired by means of the evaluating means 28. This acquired value of the rotary angle position of the rotary ring 16 is supplied, as an input value, by the evaluating means 28 to a control device of the electric power tool 10, which control device, not represented in the figures, by limiting the current of the drive motor 11, on the basis of the position of the rotary ring 16 and, if appropriate, on the basis of other, additional input quantities, sets the maximum torque of the drive motor 1 to be transmitted.

Figure 6:
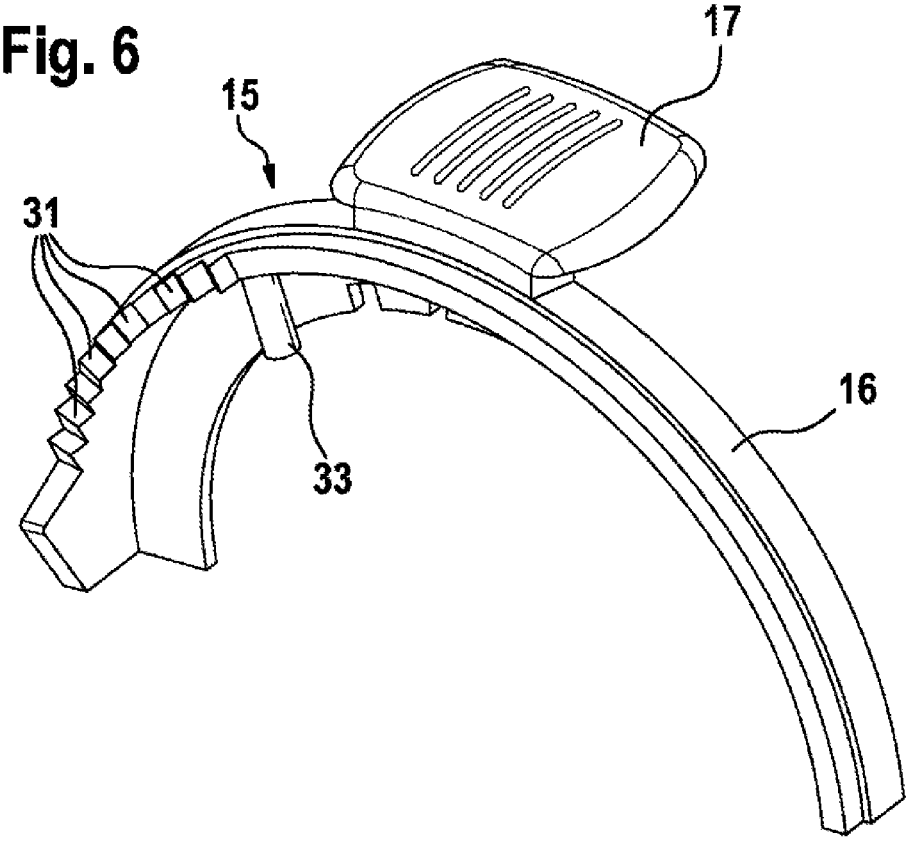
FIG. 6 shows a perspective view of a part of the actuating element realized as an adjusting ring.

FIG. 6 shows the outside face of the rotary ring 16 that is opposite the contact element 22. In this case, latching cams 31 are formed on the rotary ring 16, which latching cams act in combination with corresponding counter means, for example in the housing, upon a rotation of the rotary ring 16 and create for the operator, on the one hand, a latching that can be sensed haptically as the rotary ring 16 is being rotated and, on the other hand, a corresponding sound that can be perceived by the operator.

Figure 5:
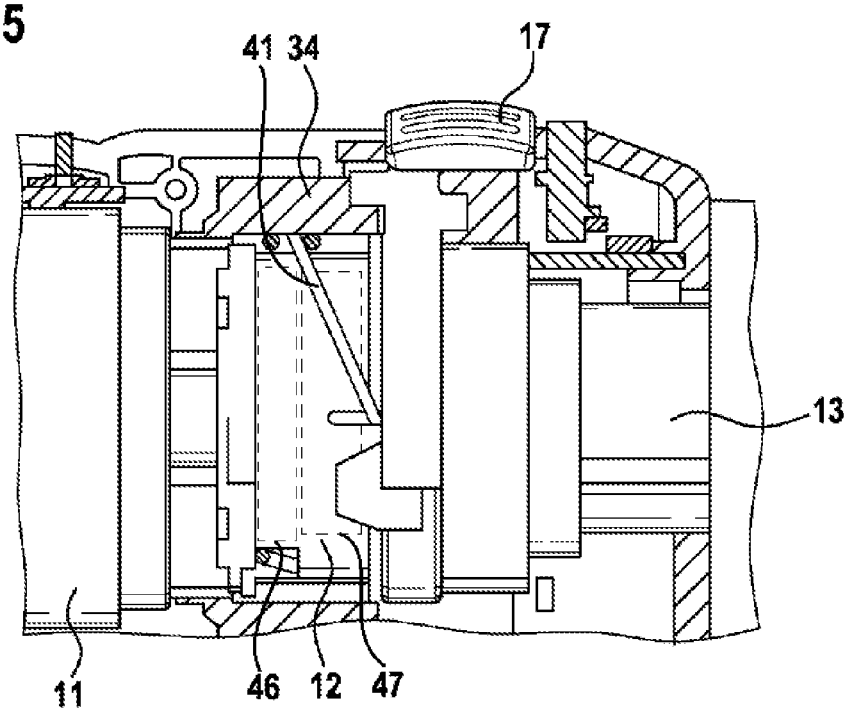
FIG. 5 shows a longitudinal section through the electric power tool in the region of the adjusting devices.
Figure 7:
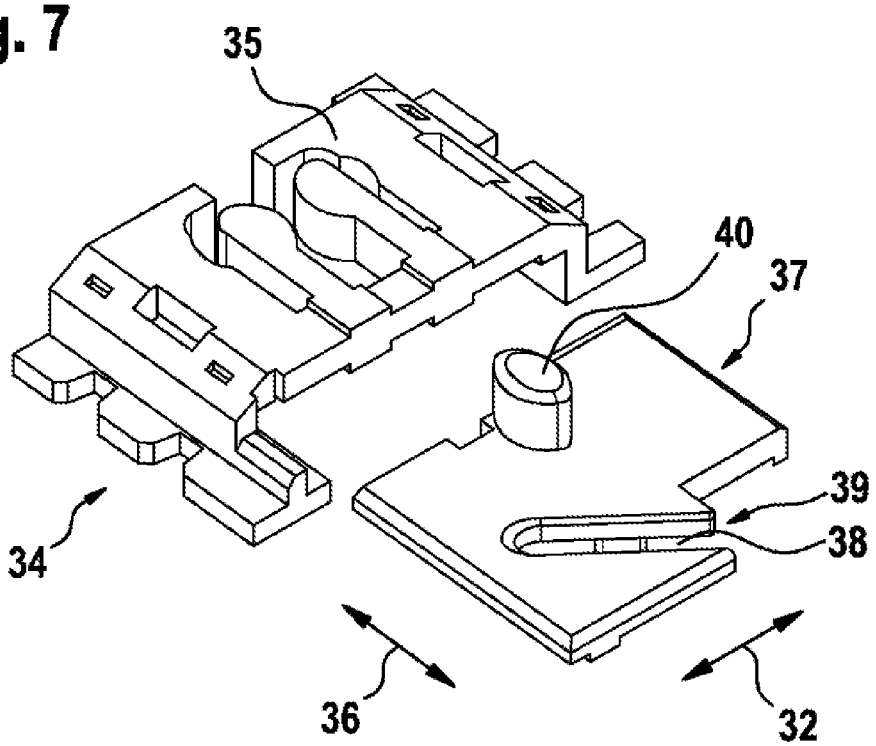
FIG. 7 shows a perspective view of individual parts of the second adjusting device.
Figure 8:
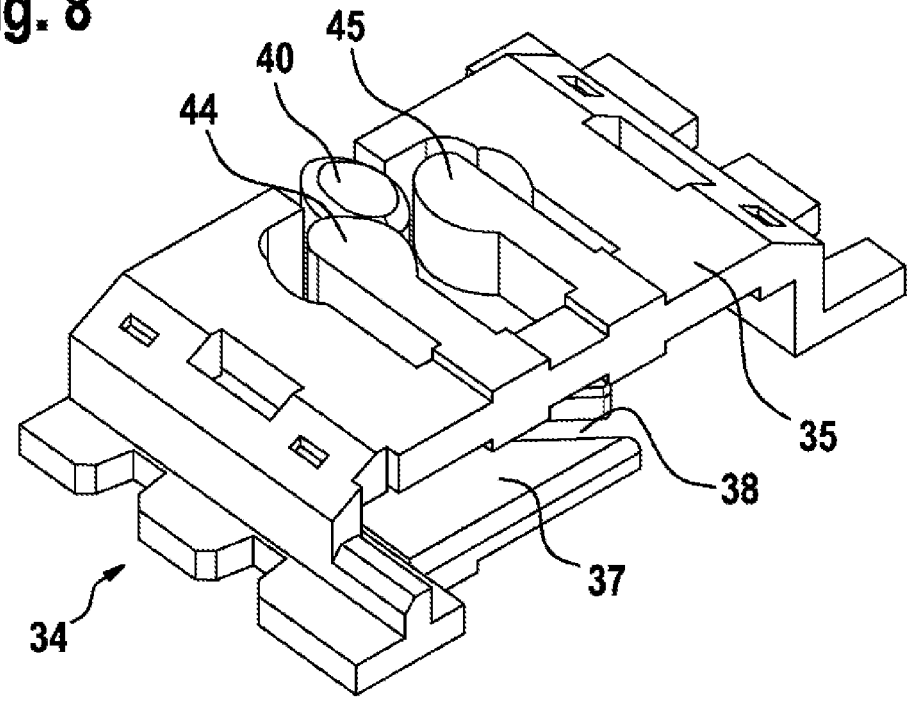
FIG. 8 and FIG. 9 show the second adjusting device in a mounted state, in differing operating positions.
Figure 9:
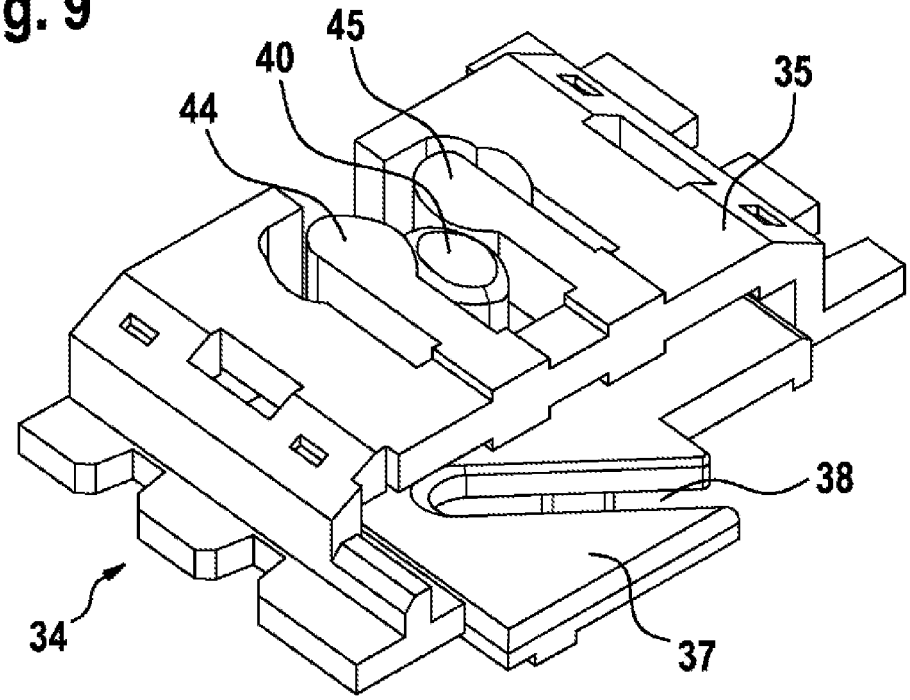
Figure 10:
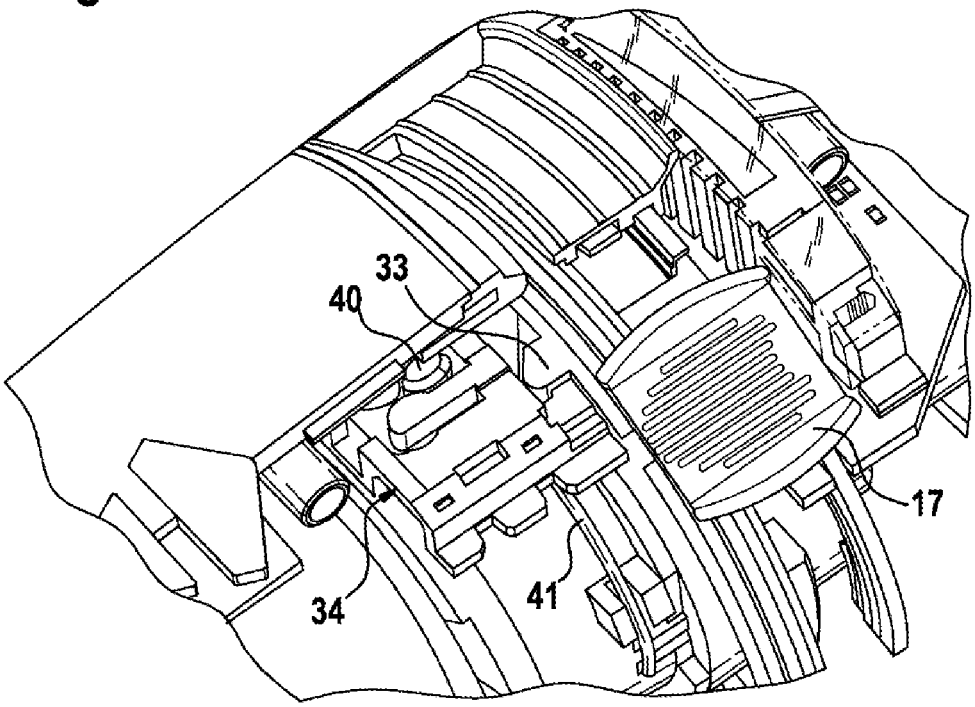
FIG. 10 shows a perspective view of the electric power tool in the region of the actuating element, the actuating element being in the drilling position.

Moreover, it can be seen that an adjusting element, in the form of an adjusting pin 33, is formed on the rotary ring 16. The adjusting pin 33 is a constituent part of a gear step preselector switch 34 that, according to FIGS. 7 to 9, comprises a guide housing 35, which is arranged in a fixed manner in the electric power tool 10, and in which there is arranged a transmission plate 37 that slides according to the double arrow 36, perpendicularly in relation to the direction of rotation of the rotary ring 16, the direction of rotation of which is denoted by the double arrow 32. Realized in the transmission plate 37 there is a guide slot 38 for the adjusting pin 33, which guide slot is open at one of its ends 39. On its top side, the transmission plate 37 has a latching cam 40, which acts in combination with two latching cleats 44, 45 formed integrally on the guide housing 35. The latching cam 40 in this case, according to the position in the transmission plate 37, assumes two positions, represented in FIGS. 8 and 9, in which the transmission plate 37, by means of a switching lever 41 coupled to the transmission plate 37, sets the transmission 12 of the electric power tool 10 either in the first gear step 46 (shown schematically in FIG. 5), which is provided for screwdriving, or in the second gear step 47 (shown schematically in FIG. 5), which is suitable for drilling. In this case, the adjustment between the two positions, i.e. the respective overcoming of the latching cleats 44, 45 (FIGS. 8 and 9) by the latching cams 40, can be perceived both haptically and acoustically by the operator.

Figure 2:
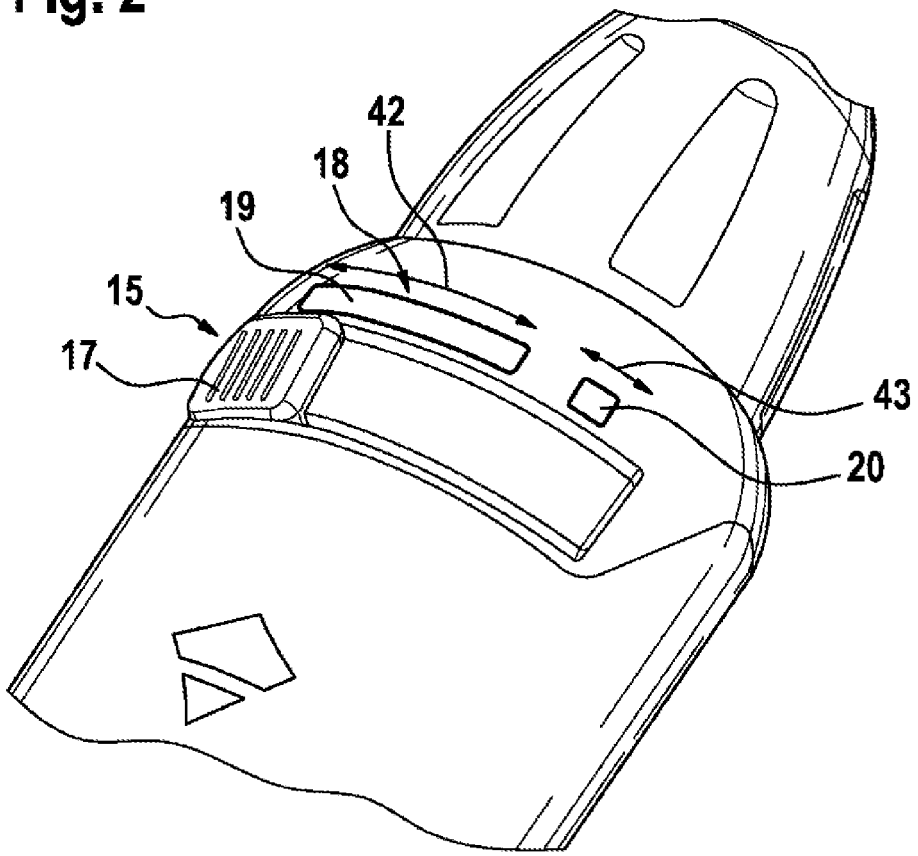
FIG. 2 shows a perspective partial view of the drill/screwdriver according to FIG. 1, in the region of its actuating element.

The gear step preselector switch 34 functions in the following manner: in the position of the rotary ring 16 in which the contact element 22 is located in the region of the printed conductors 29, 30 of the potentiometer 25, which is equivalent to a first adjustment range 42 (FIG. 2) of the rotary ring 16 for the screwdriving mode, the adjusting pin 33 is not in engagement with the guide slot 38 of the transmission plate 37. This means that the switching lever 41 assumes a position in which the transmission 12 of the electric power tool 10 is in the first gear step 46. Upon a rotation of the rotary ring 16 beyond the range of the potentiometer 25, which is equivalent to a second adjustment range 43, the adjusting pin 33 comes into engagement with the guide slot 38 of the transmission plate 37. In this case, the direction of motion of the adjusting pin 33 is denoted in FIG. 7 by the double arrow 32, as is the direction of motion of the rotary ring 16. As soon as the adjusting pin 33 is in engagement with the guide slot 38 of the transmission plate 37, the latter is moved out of the guide housing 35, such that the latching cam 40 and the switching lever 41 that is coupled to the transmission plate 37 assume their second position, represented in FIG. 9, in which the transmission plate 37 switches the transmission 12 of the electric power tool 10 into the second gear step 47, by means of the switching lever 41. The rotational speed is thereby increased, such that the electric power tool 10 is in the drilling mode. Upon a movement of the adjusting ring 16 out of the second adjustment range 43 back into the first adjustment range 42, the transmission 12 is again adjusted from the second gear step to 47 the first gear step 46 by the switching lever 41.

The electric power tool 10 described thus far can be modified in a multiplicity of ways without departure from the concept of the disclosure. This concept consists in providing a single actuating element 15 that is used for actuating differing functions on the electric power tool 10.

The invention claimed is:

1. An electric power tool comprising:

a drive motor configured to generate a motor torque;

a transmission operably connected to the drive motor and an output element, the transmission having a plurality of gear steps receiving the motor torque and transmitting an output torque to the output element;

a first adjusting device configured to set a maximum motor torque limit for the motor torque generated by the drive motor and configured to be actuated manually;

a second adjusting device configured to set the gear step of the transmission to set the output torque of the transmission and configured to be actuated manually; and a common actuating element configured to manually actuate the first adjusting device and the second adjusting device, wherein:

the first adjusting device comprises a potentiometer configured to identify a position of the actuating element, and the actuating element includes a contact element that acts as a jumper between printed conductors to vary a resistance value of the potentiometer;

the first adjusting device is configured to set the maximum motor torque limit of the drive motor based on the resistance value of the potentiometer;

the actuating element is configured to act exclusively in combination with the first adjusting device in a first adjusting range in such a way that the maximum motor torque limit is varied only by adjustment of the actuating element in the first adjusting range;

the actuating element is configured to act exclusively in combination with the second adjusting device in a second adjusting range; and the first adjusting range adjoins the second adjusting range.

2. The electric power tool as claimed in claim 1, wherein the actuating element is one of a sliding switch and a rotary switch.

3. The electric power tool as claimed in claim 1, wherein:

the potentiometer is arranged on a circuit carrier;

the circuit carrier includes an evaluating mechanism configured to identify the position of the actuating element based on the resistance value of the potentiometer; and the circuit carrier is connected to a control device configured to control a current supplied to the drive motor to set the maximum motor torque limit based on the identified position of the actuating element.

4. The electric power tool as claimed in claim 1, further comprising:

a first adjusting element arranged on the actuating element, the first adjusting element configured to act in combination with a gear step adjusting element in the second adjusting range.

5. The electric power tool as claimed in claim 4, wherein:

the second adjusting device includes a gear step preselector switch;

the first adjusting element is configured to act in combination with the gear step preselector switch;

the first adjusting element is an adjusting pin;

the gear step adjusting element is a sliding switch with a guide slot; and the adjusting pin is configured to actively engage the guide slot at a start of the second adjusting range.

6. The electric power tool as claimed in claim 5, further comprising:

a switching lever coupled to the sliding switch and configured to switch the transmission from a first gear step to a second gear step according to a particular position of the adjusting pin in the guide slot.

7. The electric power tool as claimed in claim 1, wherein a position of the actuating element is represented by an optical indicator.

8. The electric power tool as claimed in claim 7, wherein the optical indicator is arranged in a region of an adjustment path of a control element of the actuating element.

9. The electric power tool as claimed in claim 1, wherein the common actuating element is embodied as a sliding switch formed as a rotary ring, which is adjustable within a defined rotary angle range.

10. An electric power tool comprising:

a drive motor configured to generate a motor torque;

a transmission operably connected to the drive motor and including a plurality of gear steps, the transmission being configured to receive the motor torque and transmit an output torque to an output element;

a first adjusting device configured to set the motor torque and configured to be actuated manually;

a second adjusting device configured to set the gear step of the transmission to set the output torque and configured to be actuated manually, the second adjusting device including a gear step preselector switch;

a common actuating element configured to manually actuate the first adjusting device and the second adjusting device; and an adjusting pin arranged on the actuating element, the adjusting pin configured to act in combination with a gear step adjusting element in a second adjusting range, wherein:

the actuating element is configured to act exclusively in combination with the first adjusting device in a first adjusting range;

the actuating element is configured to act exclusively in combination with the second adjusting device in the second adjusting range;

the first adjusting range adjoins the second adjusting range;

the adjusting pin is configured to act in combination with the gear step preselector switch;

the gear step adjusting element is a sliding switch with a guide slot; and the adjusting pin is configured to actively engage the guide slot at a start of the second adjusting range.

11. The electric power tool as claimed in claim 10, further comprising:

a switching lever coupled to the sliding switch and configured to switch the transmission from a first gear step to a second gear step according to a particular position of the adjusting pin in the guide slot.

* * * * *